US011344177B2

(12) United States Patent
Kafzan

(10) Patent No.: US 11,344,177 B2
(45) Date of Patent: May 31, 2022

(54) SPRAY ASSEMBLY AND REPLACEABLE DETERGENT CONTAINER FOR DISHWASHER

(71) Applicant: Deeay Technologies Ltd., Tel Aviv (IL)

(72) Inventor: Abraham Kafzan, Tel Aviv (IL)

(73) Assignee: DEEAY TECHNOLOGIES LTD., Tel Aviv (IL)

( * ) Notice: Subject to any disclaimer, the term of this patent is extended or adjusted under 35 U.S.C. 154(b) by 156 days.

(21) Appl. No.: 16/734,750

(22) Filed: Jan. 6, 2020

(65) Prior Publication Data

US 2020/0253450 A1 Aug. 13, 2020

(30) Foreign Application Priority Data

Feb. 11, 2019 (GB) ..... 1901831

(51) Int. Cl.
*A47L 15/22* (2006.01)
*A47L 15/30* (2006.01)
(Continued)

(52) U.S. Cl.
CPC ..... *A47L 15/22* (2013.01); *A47L 15/30* (2013.01); *A47L 15/4217* (2013.01); *A47L 15/4282* (2013.01); *A47L 15/4418* (2013.01)

(58) Field of Classification Search
CPC ..... A47L 15/22; A47L 15/30; A47L 15/4217; A47L 15/4282; A47L 15/4418;
(Continued)

(56) References Cited

U.S. PATENT DOCUMENTS 3,060,946 A 10/1962 Lantz
5,704,380 A * 1/1998 Zelniker ..... A47L 15/0073 134/153
(Continued)

FOREIGN PATENT DOCUMENTS

| | | |
|---|---|---|
| CN | 108245108 | 7/2018 |
| DE | 2511864 | 10/1976 |
| JP | 2626706 | 2/1990 |

OTHER PUBLICATIONS

Official Letter and Combined Search and Examination Report fro corresponding application GB1901831.6 dated Jul. 24, 2019.
(Continued)

*Primary Examiner* — Michael E Barr
*Assistant Examiner* — Pallavi Chitta
(74) *Attorney, Agent, or Firm* — Niels Haun; Dann, Dorfman, Herrell & Skillman, P.C.

(57) ABSTRACT

A spray assembly for a dishwasher of the kind wherein utensils are disposed inside a dishwashing chamber and a generally L-shaped spray assembly is rotated to and fro so that a horizontal leg thereof sweeps across a lower surface of the dishwashing chamber and a vertical leg of the spray assembly sweeps across a side wall of the dishwashing chamber. The spray assembly has channels for conveying detergent and hot water and further has multiple nozzles disposed along the horizontal and vertical legs for directing detergent and hot water on to the utensils inside the dishwashing chamber from multiple different directions as the spray assembly rotates. A fluid inlet coupler at an end of the spray assembly is adapted for coupling to a rotatable hub having duct connectors projecting downwardly substantially parallel to an axis of rotation of the hub and fluidly coupled to respective channels of the spray assembly.

13 Claims, 8 Drawing Sheets

(51) Int. Cl.
*A47L 15/42* (2006.01)
*A47L 15/44* (2006.01)

(58) Field of Classification Search
CPC .. A47L 15/0073; A47L 15/20; A47L 15/4214; A47L 15/0089; B01L 2400/0487; B01L 13/02
See application file for complete search history.

(56) References Cited

U.S. PATENT DOCUMENTS

| | | | | |
|---|---|---|---|---|
| 5,879,469 | A | 3/1999 | Avram | |
| 2011/0220149 | A1* | 9/2011 | Thiyagarajan | A47L 15/23 134/18 |
| 2020/0245840 | A1* | 8/2020 | Haegermarck | A47L 15/4221 |

OTHER PUBLICATIONS

International Search report for corresponding application PCT/IL2019/051358 dated May 8, 2020.
International Written Opinion for corresponding application PCT/IL2019/051358 dated May 8, 2020.

* cited by examiner

SPRAY ASSEMBLY AND REPLACEABLE DETERGENT CONTAINER FOR DISHWASHER

FIELD OF THE INVENTION

The present invention relates to table-top dishwashing machines for washing a small number of dishes, e.g. glasses, intended to be used in offices, or the like.

BACKGROUND OF THE INVENTION

U.S. Pat. No. 5,704,380 discloses a dishwashing machine for washing dishes with a very rapid washing cycle in which water and detergent are sprayed through different spraying nozzles in different operational stages within the dishwashing cycle. Utensils to be washed are placed on a forward semi-circular portion of a carousel tray, which rotates through 180° so as to bring the utensils into a dishwashing chamber where heated water and detergent are sprayed sequentially from multiple directions. This is achieved using a spray assembly in the form of a rotatable L-shaped arm comprising a horizontal leg below the tray and a vertical leg extending above the upper faces of the dishes. The horizontal leg supports nozzles for spraying liquid upwards onto the lower face of the dishes and the vertical leg supports nozzles for spraying liquid sideways and/or downwards with a slant, for spraying liquid on the upper faces of the dishes.

FIG. 1 shows that the spray assembly 10 has a horizontal leg 11 and a vertical leg 12. The horizontal leg 11 has three integral liquid passages leading from respective duct connectors, of which only two 13, 14 are shown and which are fluidly coupled to nozzles 15 on both the horizontal and vertical legs. Two of the duct connectors are coupled via respective ducts 16 and 17 to separate detergent reservoirs (not shown), while a third duct connector is coupled via a duct 18 to a source of hot water. The actual nozzles through which each liquid i.e. water or detergent is emitted are predetermined by the internal channels of the horizontal and vertical legs. Since there are three separate channels, there are three arrays of nozzles, whose respective nozzles are denoted 15, 15' and 15". Pumps convey liquid at high pressure through the ducts so that the nozzles spray the water and detergent at high pressure.

In use, the spray assembly is rotated about a vertical axis of rotation 19 toward an end of the horizontal leg such that the vertical arm sweeps circularly around the utensils. The very fast cleaning cycle of the dishwasher is achieved by spraying the water and detergent from multiple directions sequentially and also by directing different types of detergent through the two channels: first alkaline and then acidic as disclosed in U.S. Pat. No. 5,879,469.

Although the dishwasher described in the above two patents works well, the spray assembly has two drawbacks. One relates to the fact that the duct connectors are discrete elements that are push-fitted onto the horizontal and vertical legs. This increases the complexity of the assembly since more parts are required, thereby increasing assembly time and cost. The second drawback is that flexible ducts are push-fitted on to the duct connectors, which as seen in FIG. 1 are fixed on a lower surface of the horizontal leg remote from the axis of rotation 19. As a result, rotation of the spray assembly subjects the ducts to mechanical forces along the axis of the joints and this has been found to induce disconnection from the duct connectors, which must withstand high pressure liquid flow through the joints. This results in leaks and wastage of both water and detergent.

Another albeit lesser drawback of the dishwasher described in the two cited patents concerns the manner in which detergent is replenished. Detergent is stored in two reservoirs at the bottom of the dishwasher and pumped under pressure through the respective ducts and obviously must be replenished periodically. Two approaches are discussed. The detergent reservoir may be an internal reservoir that is periodically filled by the appropriate detergent. Alternatively the detergent reservoir may be a replaceable container having a discharge opening covered by a pierceable cap, which upon insertion is pierced by needles whereupon the detergent contained in each of these compartments can be drawn by respective pumps. The needles must pierce at least two openings in the cap: one to discharge liquid and the other to admit air. The resulting mechanism and the need for two pumps increase the complexity, bulk and cost of the dishwasher.

SUMMARY OF THE INVENTION

It is an object of the present invention to provide a spray assembly and an improved replaceable detergent container for a dishwasher of the kind disclosed in the above-referenced patents where these drawbacks are addressed.

This object is realized in accordance with the invention by a spray assembly and replaceable detergent bottle having the features of the respective independent claims.

BRIEF DESCRIPTION OF THE DRAWINGS

In order to understand the invention and to see how it may be carried out in practice, embodiments will now be described, by way of non-limiting example only, with reference to the accompanying drawings, in which.

DETAILED DESCRIPTION OF EMBODIMENTS

In the following description of some embodiments, identical components that appear in more than one figure or that share similar functionality will be referenced by identical reference symbols. The drawings show features whose detailed construction and operation are not part of the present invention per se and are described in U.S. Pat. No. 5,704,380 to which further reference may be made. In saying this, it is to be noted and emphasized that the present invention does not require that operation of the dishwasher be identical to that described in the above patents. The operation is determined by a microcontroller, which is not itself a feature of the present invention but may be pre-programmed or programmable to operation according to different cycles than those described in the above patents.

Figure 2:
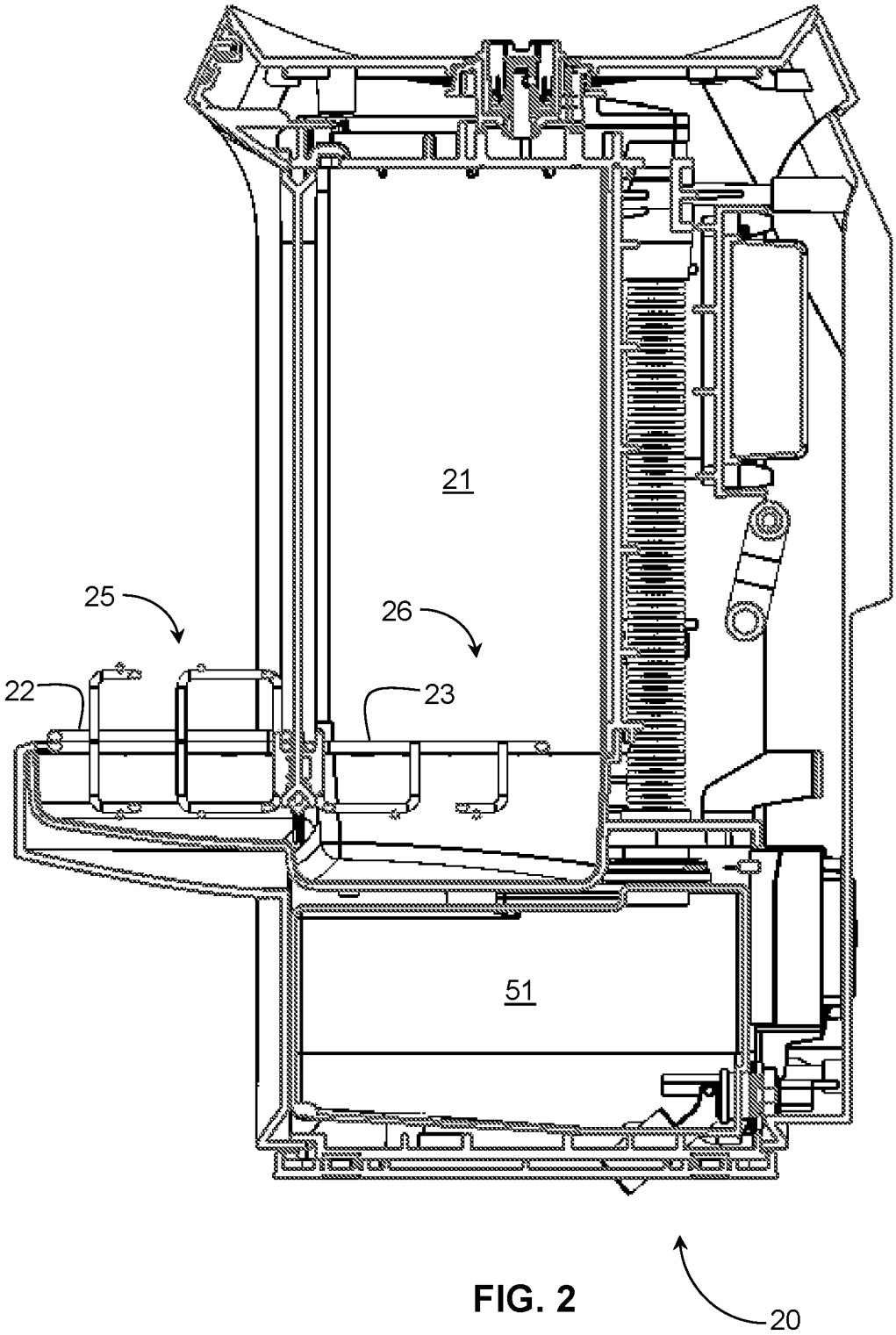
FIG. 2 is a cross-sectional side elevation of the complete dishwasher according to the invention.
Figure 3:
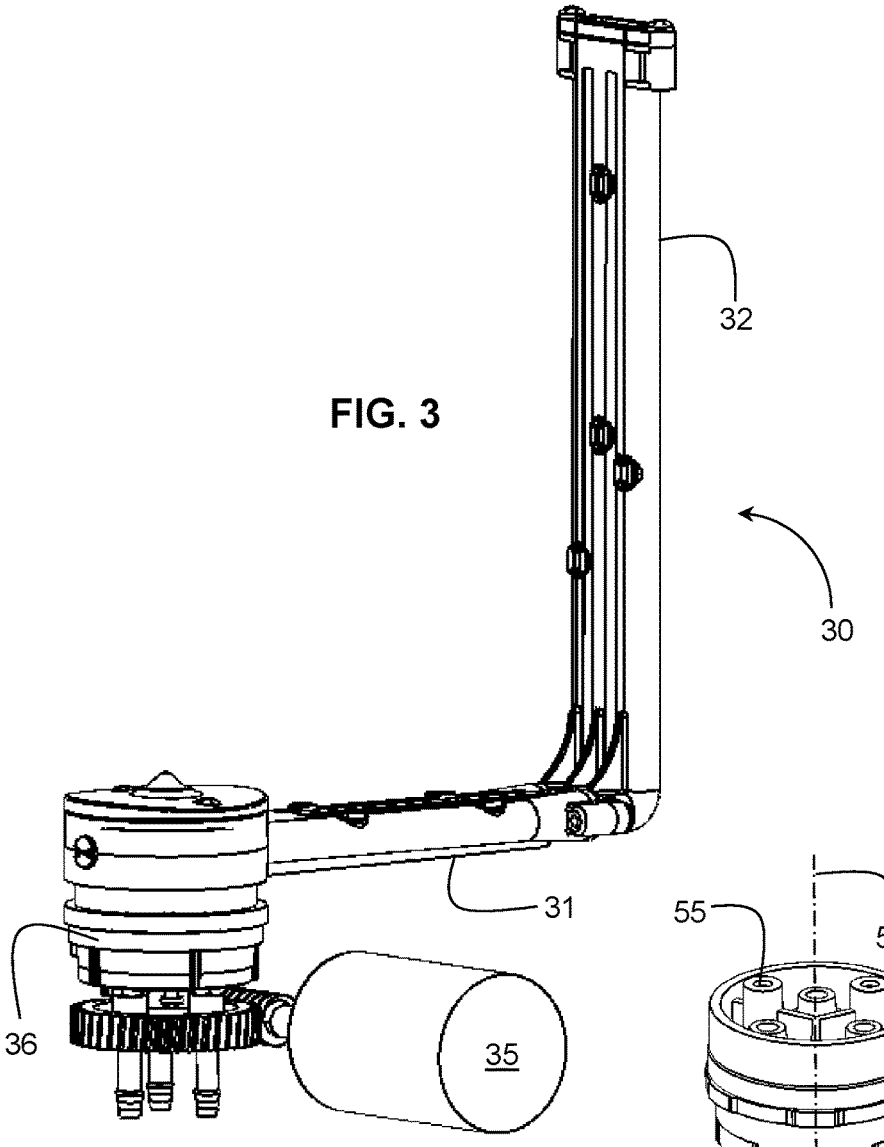
FIG. 3 is a pictorial representation showing a detail of a spray assembly according to the invention rotatably coupled to a motor.
Figure 5A:
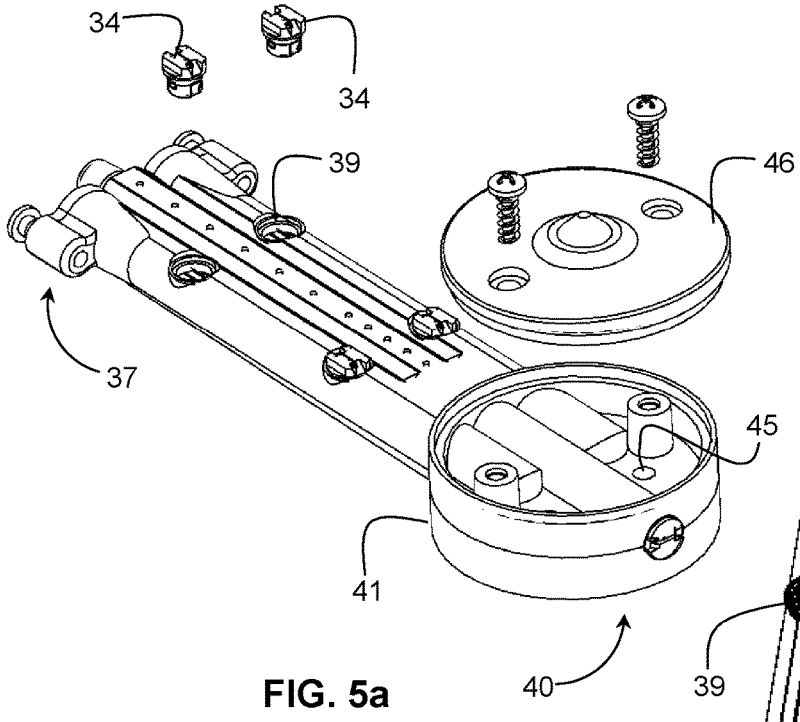
FIGS. 5*a*, 5*b* and 5*c* show pictorially components of the spray assembly before and after assembly.
Figure 5B:
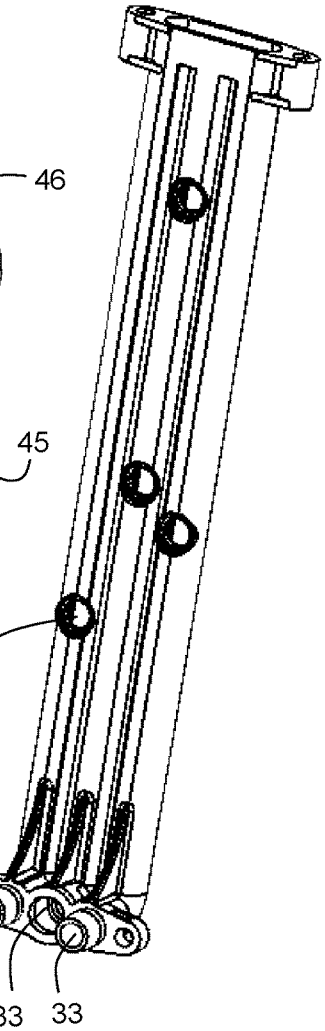
Figure 5C:
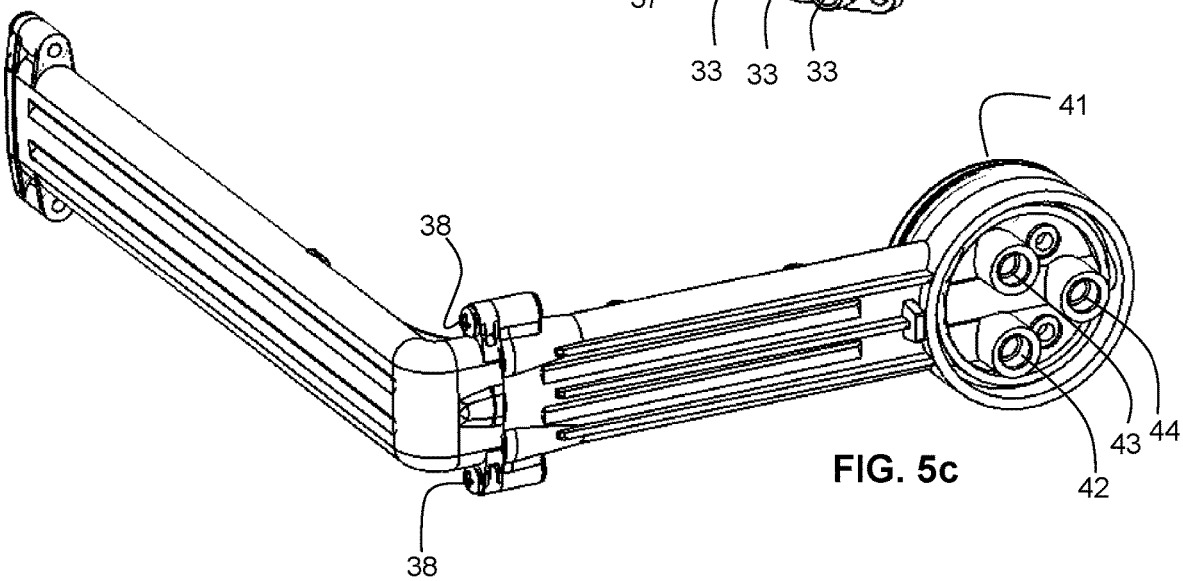

The invention relates to improvements to a dishwasher 20 shown in partial sectional elevation in FIG. 2 of the kind wherein utensils are disposed inside a dishwashing chamber 21. A dish holder 22 holds dishes within the dishwashing chamber, and includes a loading-unloading rotatable tray 23 divided by a vertical water impermeable partition 24 into two identical portions 25, 26. The tray 23 is positioned such that when one of the identical portions is within the dishwashing chamber 21, the other portion is outside the chamber and by rotation of the tray the positions of the portions are interchanged, the partition being capable of water-tight engagement with adjacent wall portions of the dishwashing chamber. A generally L-shaped spray assembly 30 is rotated to and fro so that a horizontal leg 31 thereof sweeps across a lower surface of the dishwashing chamber and a vertical leg 32 of the spray assembly 30 sweeps across a side wall of the dishwashing chamber. The spray assembly 30 has channels 33 (shown in FIG. 5*b*) for conveying detergent and hot water and has multiple nozzles 34 disposed along the horizontal and vertical legs for directing detergent and hot water on to utensils inside the dishwashing chamber from multiple different directions as the spray assembly rotates.

Figure 4:
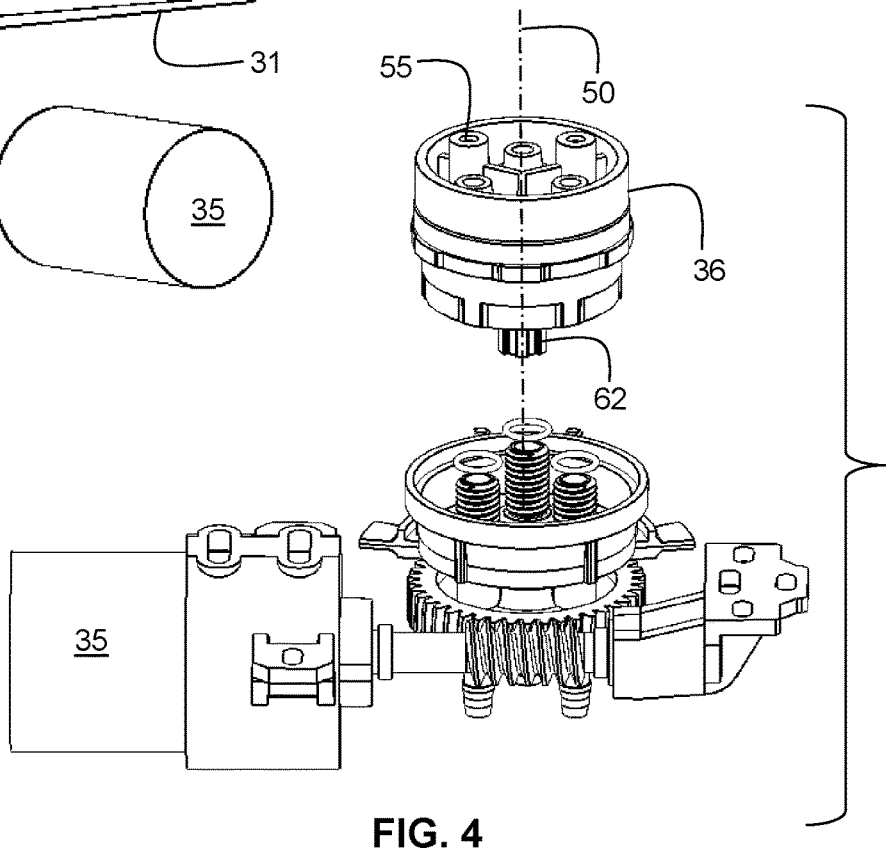
FIG. 4 is a pictorial representation of a base connector adapted for fixing to the spray assembly of FIG. 3.
Figure 6A:
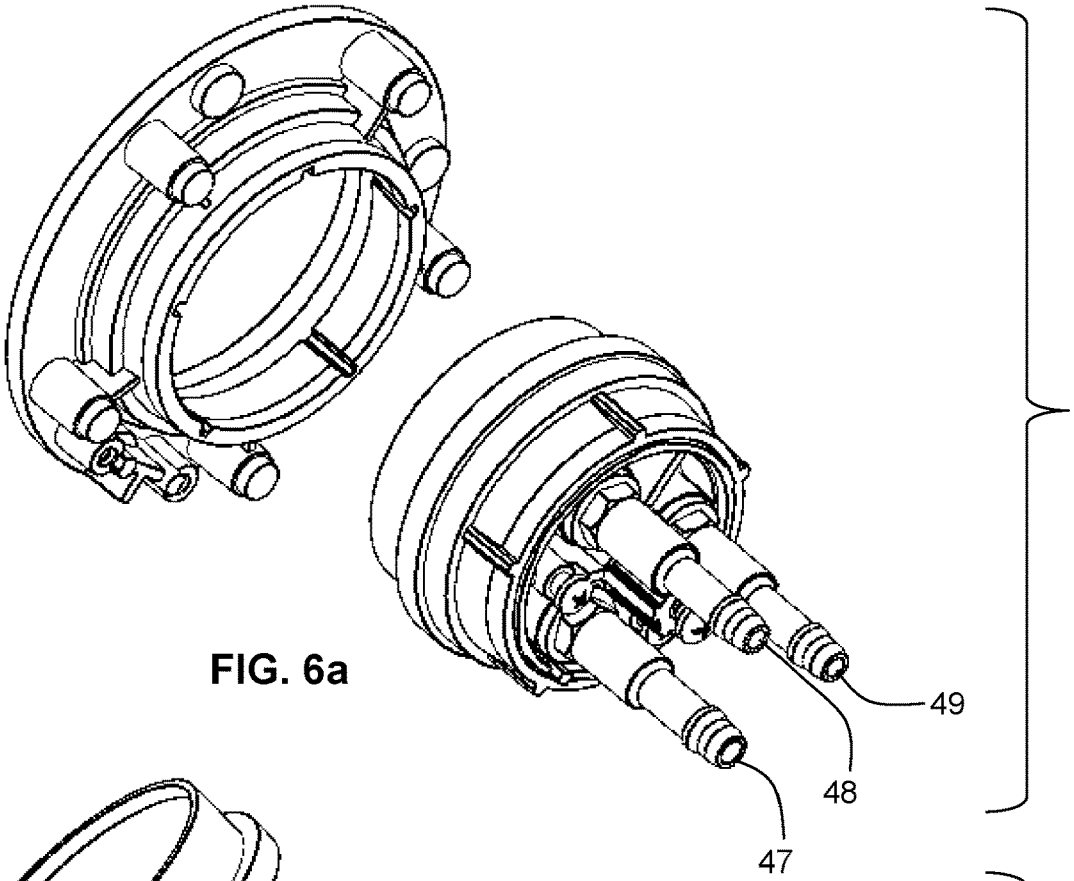
FIGS. 6*a*, 6*b* and 6*c* are exploded views showing details of a hub mountable at an end of the spray assembly and having duct connectors fluidly coupled to the channels of the spray assembly.
Figure 6B:
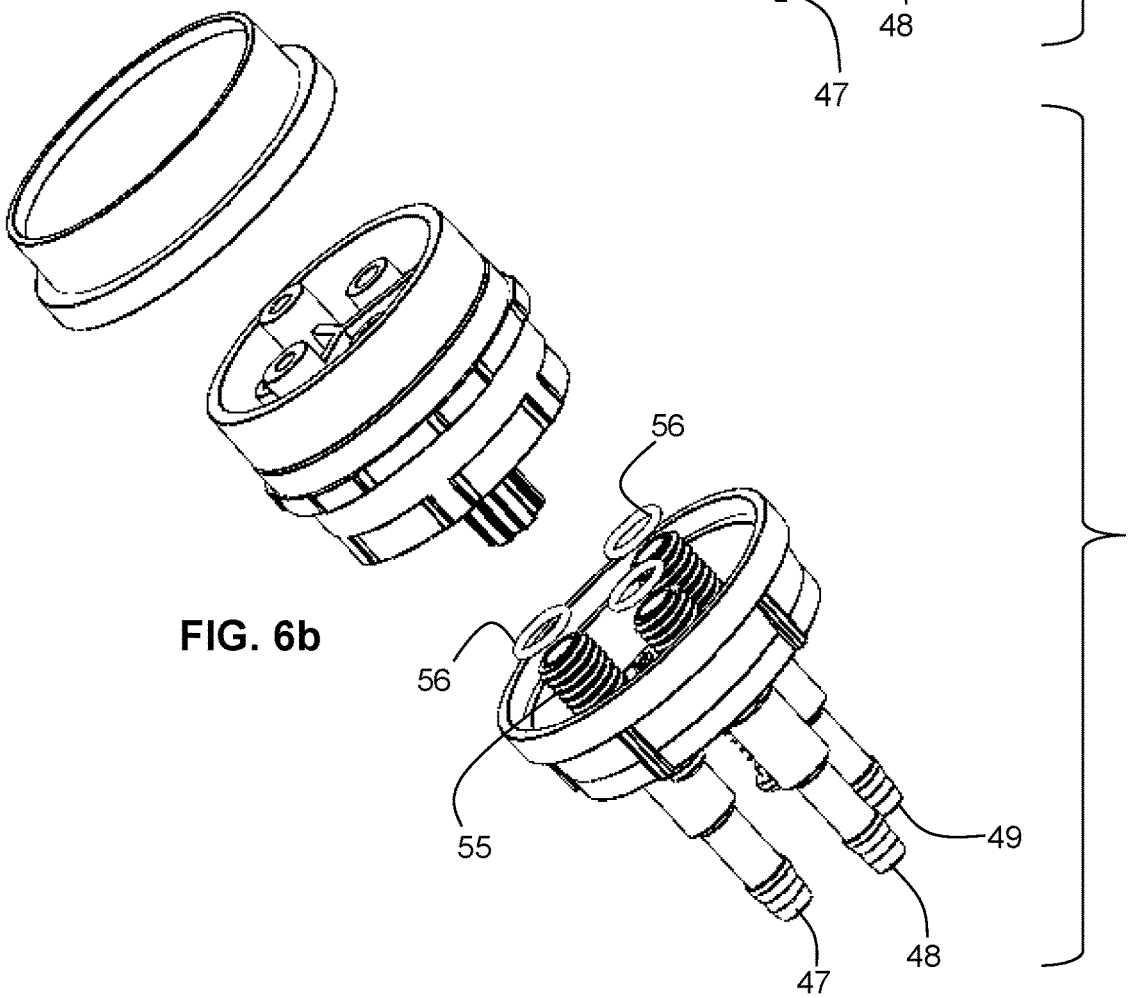

Referring to FIGS. 3 to 6*c*, there are shown details of the spray assembly 30 rotatably coupled to a motor 35 by means of a rotatable hub 36, which may be a two-part assembly as shown in FIGS. 4 and 6*b* or a unitary molding of the form shown in FIG. 6*a*. According to an embodiment of the invention, each of the horizontal and vertical legs is a unitary molding in which the respective channels of both legs are spatially aligned, the two legs being fixedly attached at respective first ends 37, 37' by screws 38 so that liquid flowing through a channel of the horizontal leg is conveyed through the corresponding channel of the vertical leg. Bores 39 for accommodating the nozzles 34 are recessed into the horizontal and vertical legs so as to intersect the respective channels therein. The spray assembly 30 comprises at a second end 40 a fluid inlet coupler 41 adapted for coupling to the hub 36. Preferably, the fluid inlet coupler 41 is integrally molded with the horizontal leg 31 and for each channel therein has a respective downwardly depending tubular inlet 42, 43 and 44 integrally formed with the respective channel. Apertures 45 through an internal base of the fluid inlet coupler 41 allow the fluid inlet coupler 41 to be fixed to the hub by screws (not shown). This connection is concealed by a cover 46 that is screwed to the fluid inlet coupler 41. As best seen in FIG. 6*a*, the hub 36 comprises a cylindrical housing supporting at a lower end duct connectors 47, 48 and 49, each in alignment with to a respective inlet of the fluid inlet coupler 41. The duct connectors 47, 48 and 49 project downwardly substantially parallel to an axis of rotation 50 of the hub and when assembled to the fluid inlet coupler 41 are fluidly coupled to respective channels of the spray assembly. In use, the duct connectors 46, 47 and 48 are respectively coupled to a hot water source and to two different types of detergent contained in respective reservoirs 51.

Figure 6C:
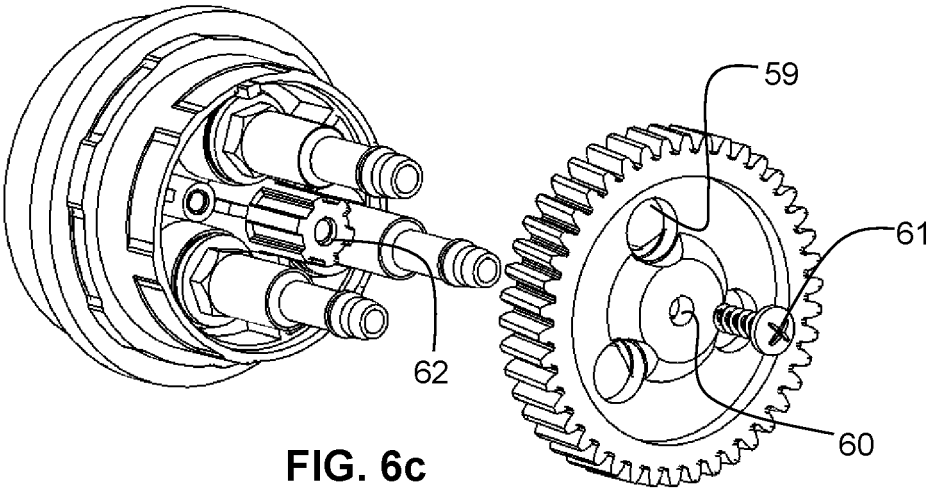

The duct connectors extend through the hub and form upwardly protruding tubes 55 that are dimensioned for tight accommodation within corresponding inlets of the fluid inlet coupler 41. The resulting joints are fluidly sealed by respective O-rings 56 that are fitted over the tubes 55 prior to assembly of the hub 36 to the fluid inlet coupler 41, which are then attached to each other using screws as described above. As shown in FIG. 6*c*, a gear wheel 58 is fitted at the lower end of the hub 36, the gear wheel 58 having apertures 59 for accommodating therethrough the respective duct connectors and a central aperture 60 by means of which the gear wheel is attached by a screw 61 to a boss 62 that protrudes downwardly from an axis of the hub. The motor 35 rotates a worm gear 63 fixed to the motor shaft and engaging the gear wheel 58, thereby rotating the hub 36.

Figure 1:
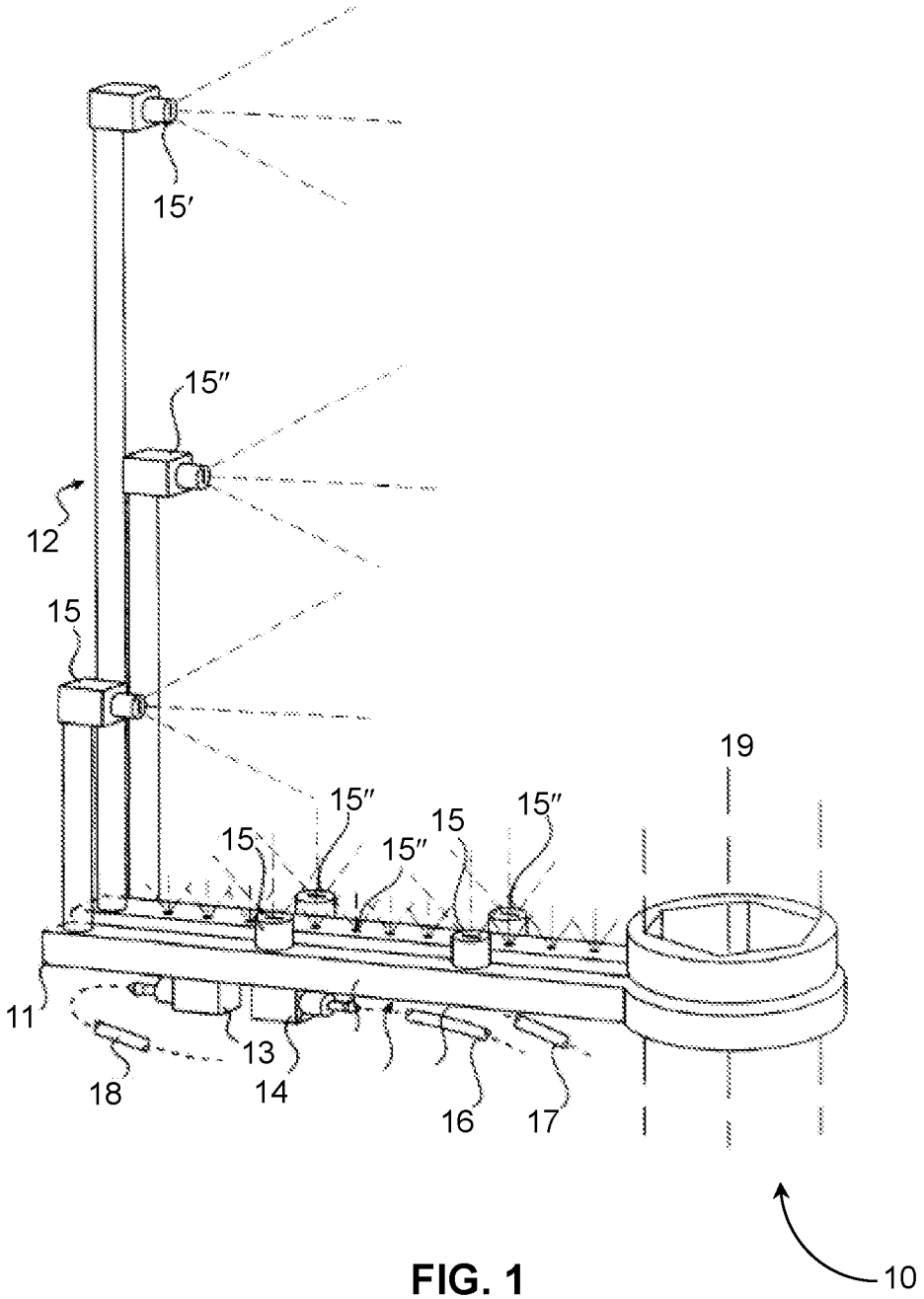
FIG. 1 (Prior Art)
FIG. 1 is a pictorial representation of a prior art spray assembly for a table-top dishwashing machine.
Figure 7:
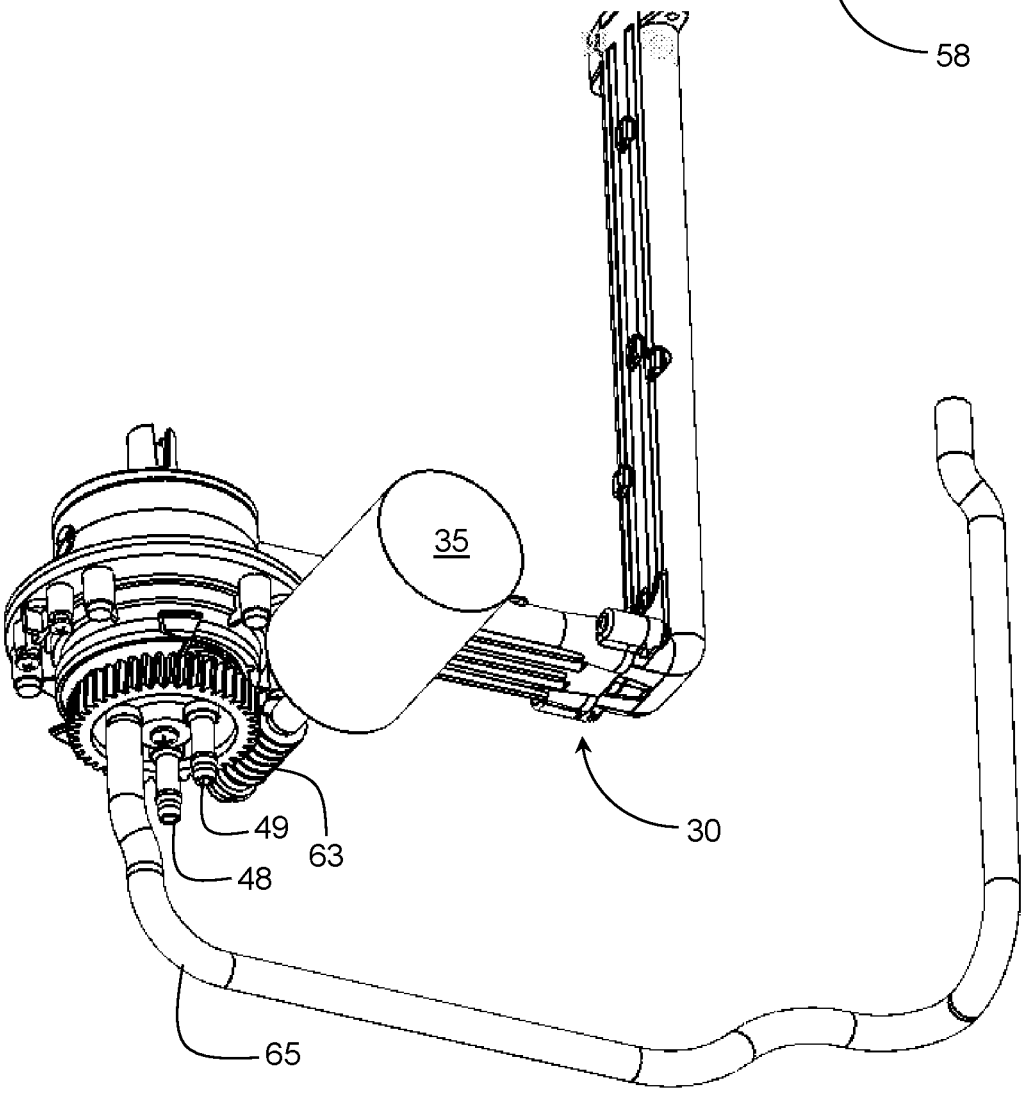
FIG. 7 shows pictorially connection of a duct to the spray assembly.

FIG. 7 shows pictorially connection of a duct 65 to the spray assembly 30, it being noted that the duct is fitted axially onto the respective downwardly protruding duct connector 48 in a direction that is therefore parallel to the axis of rotation of the hub. For the sake of clarity, the actual direction may be slightly offset from the axis of rotation of the hub for example by as much as 10-15° with derogating from the principle of the invention, which resides in the fact that to and from rotation of the hub causes the ends of the ducts 65 where they are attached to the hub to rotate in a plane normal to the axis of rotation of the hub. Thus, unlike the arrangement shown in FIG. 1, no axial force is applied to the ducts owing to rotation of the hub. As a result, the connections of the ducts to the corresponding duct connectors are more secure and far less prone to undesired decoupling notwithstanding the high pressure of the water and detergent conveyed through the ducts.

Figure 8:
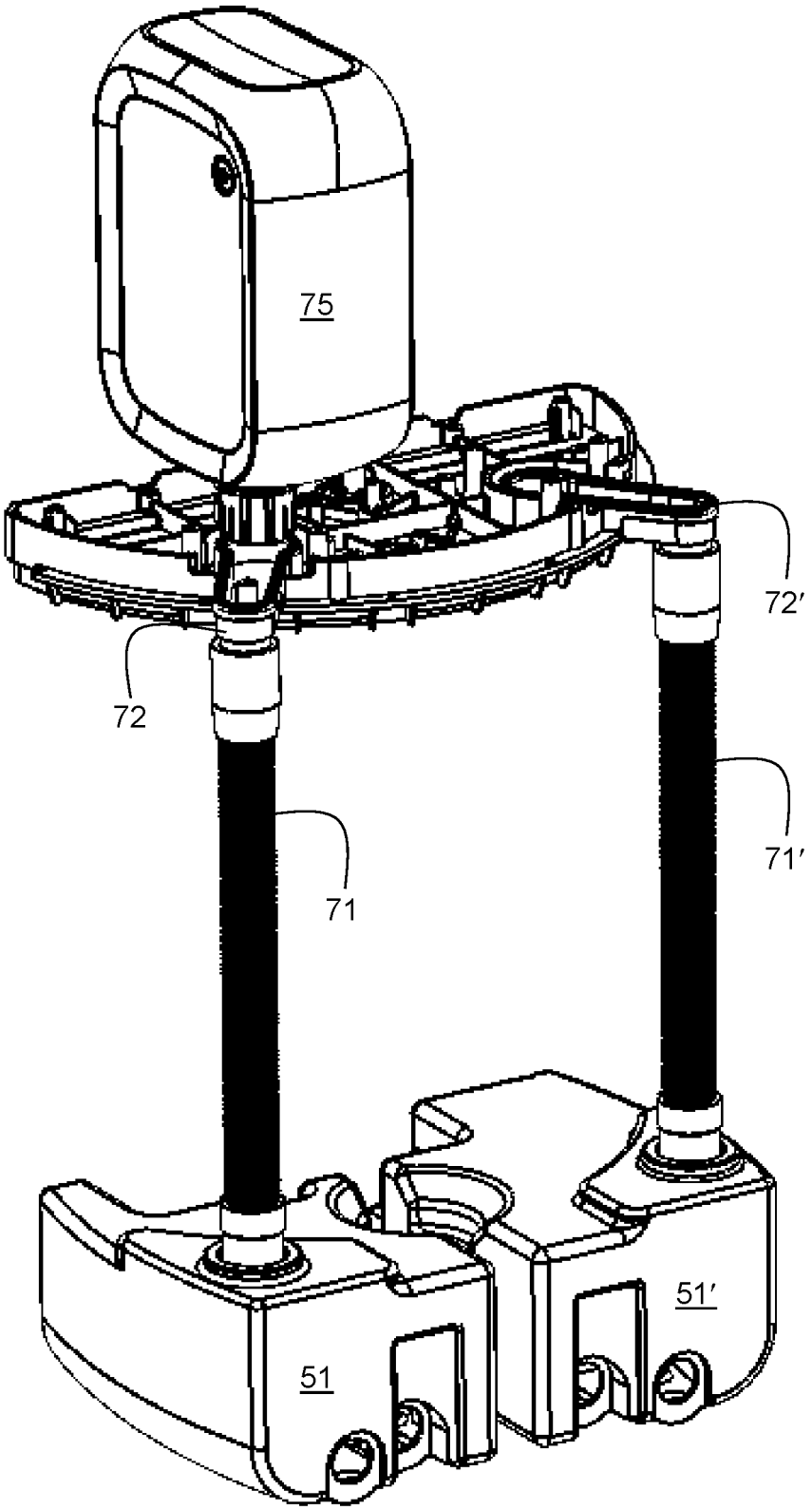
FIG. 8 shows pictorially use of a detergent bottle according to the invention for replenishing detergent.
Figure 9:
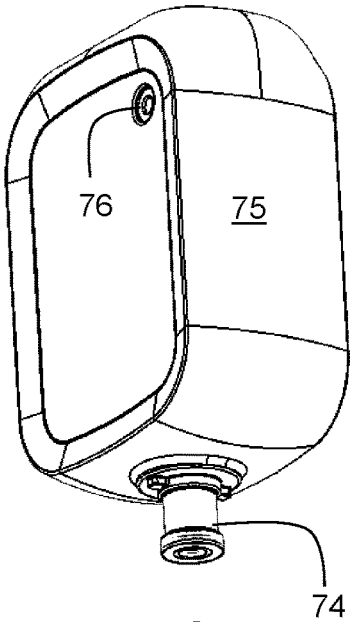
FIG. 9 is a detailed view of the detergent bottle shown in FIG. 8.
Figure 10:
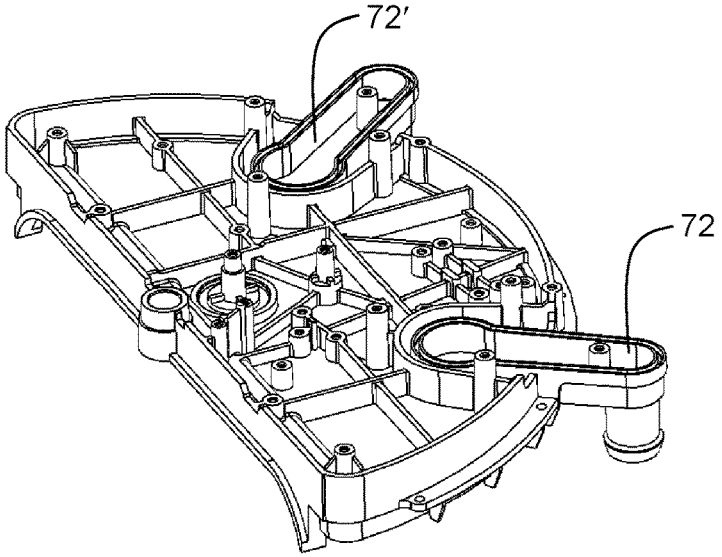
FIG. 10 shows a detail of a bottle mount for inserting a replaceable detergent container on to a filling assembly.
Figure 11:
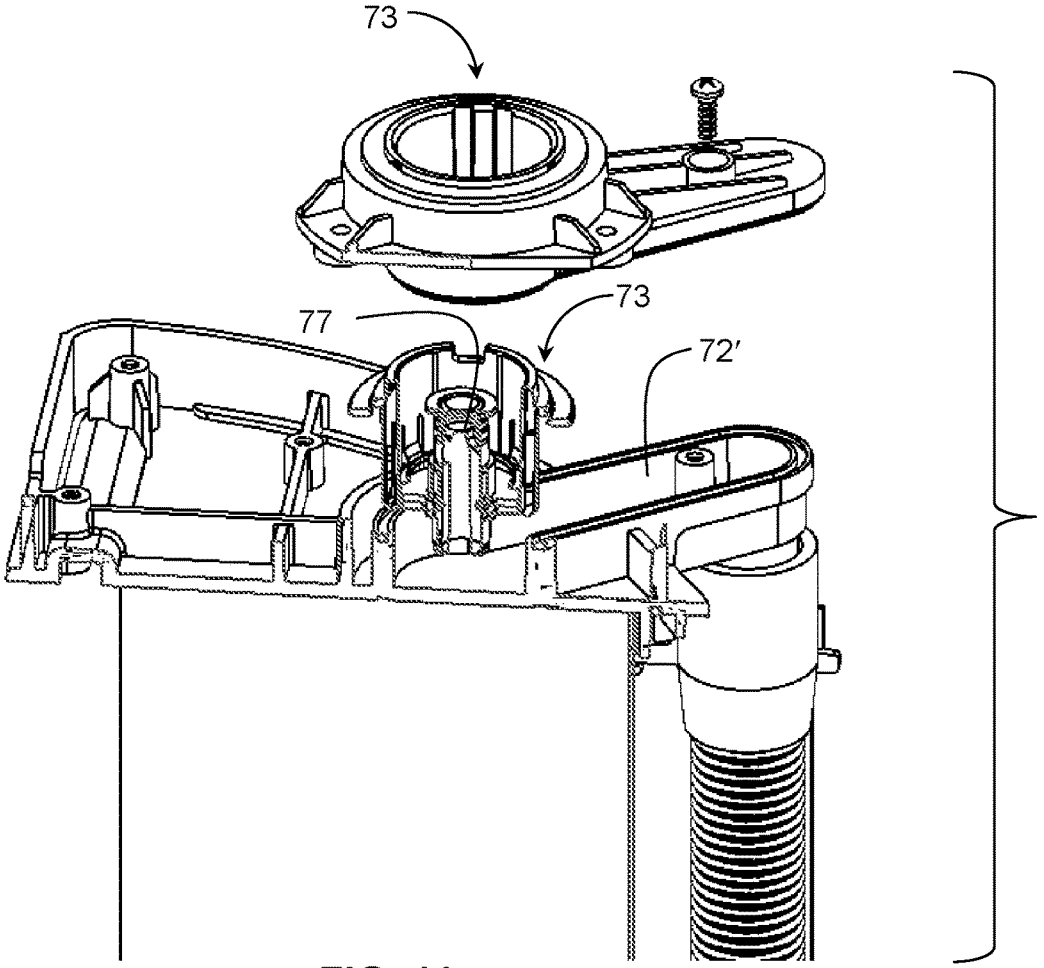
FIG. 11 is a partial exploded cross-section showing a detail of the bottle mount.

Referring now to FIGS. 8 to 10, it is seen that toward a base of the dishwasher there are provided separate detergent reservoirs 70, 70' each fluidly connected via a respective filler tube 71, 71' to a respective trough 72, 72' at an upper end of the dishwasher. Each trough is in fluid communication with a respective bottle mount 73 dimensioned to accommodate a neck 74 of a detergent bottle 75. The detergent bottle 75 has a one-way valve 76 in a side thereof toward a base of the bottle that allows for free entry of air when the bottle is emptied of detergent. The bottle mount 73 has an upwardly projecting tube 77 adapted to pierce a seal in the bottle's neck 74 thereby allowing detergent to flow under gravity alone from the bottle 75 to the reservoir 70. This free flow of liquid under gravity is facilitated by the air valve 76, which while preventing liquid detergent from spilling out lets air in thereby allowing detergent to escape through the neck of the inverted bottle without the need for a pump as required in U.S. Pat. No. 5,704,380.

It will be appreciated that while a number of embodiments have been described, these are by way of example only and variations may be carried out without departing from the scope of the appended claims.

As noted above, the present invention does not require that operation of the dishwasher be identical to that described in the above patents.

Likewise, the term "dishwasher" is not to be construed as being limited to domestic or office use for cleaning cutlery and crockery. By way of example, the dishwasher may be used in laboratories or in medical/surgical facilities, such as a dental surgery, where it may be used to clean and sterilize instruments between patients. In such a context, it has been found beneficial to spray first with cold water in order to remove blood which would otherwise stain the instruments if the water is too hot. The dishwasher may therefore be provided with different settings according to desired use, where water temperature and duty cycle are varied. In some applications, cold water may be used and in others cold and hot water may be sprayed simultaneously as a mixture or in alternate cycles separately. Thus, while the spray assembly may have three channels as described in with particular reference to the drawings, it is to be understood that no such restriction is implied. There may be as few as two or there may be more than three, the important feature being that the ducts are coupled to the spray assembly in a direction that is parallel to its axis of rotation so that rotation of the spray assembly does not apply axial forces to the ducts which can loosen their connection to the spray assembly with extended use.

It should also be noted that features that are described with reference to one or more embodiments are described by way of example rather than by way of limitation to those embodiments. Thus, unless stated otherwise or unless particular combinations are clearly inadmissible, optional features that are described with reference to only some embodiments are assumed to be likewise applicable to all other embodiments also.

The invention claimed is:

1. A spray assembly for a dishwasher of a kind wherein utensils are disposed inside a dishwashing chamber and an L-shaped spray assembly is rotated about a vertical axis so that a horizontal leg of the L-shaped spray assembly sweeps across a lower surface of the dishwashing chamber and a vertical leg of the L-shaped spray assembly sweeps across a side wall of the dishwashing chamber, the spray assembly having channels for conveying detergent and water and further having multiple nozzles disposed along the horizontal and vertical legs for directing detergent and water on to the utensils inside the dishwashing chamber from multiple different directions as the spray assembly rotates; wherein the spray assembly further comprises:

a fluid inlet coupler at an end of the horizontal leg of the spray assembly adapted for coupling to a rotatable hub of the type having duct connectors projecting downwardly parallel to an axis of rotation of the hub and fluidly coupled to respective channels of the spray assembly;

the fluid inlet coupler being integrally molded with the horizontal leg of the spray assembly and comprising for each channel thereof a respective downwardly projecting inlet integrally formed with said channel, each of said inlets being adapted to couple and to seal to respective ones of the duct connectors.

2. The spray assembly according to claim 1, wherein each of the horizontal and vertical legs is formed as unitary molding to which the nozzles are separately fitted.

3. The spray assembly according to claim 1, comprising three channels of which one is adapted for spraying water and two are adapted for spraying detergent.

4. The spray assembly according to claim 2, comprising three channels of which one is adapted for spraying water and two are adapted for spraying detergent.

5. A dishwasher comprising:

a dishwashing chamber and an L-shaped spray assembly that is rotated about a vertical axis so that a horizontal leg of the L-shaped spray assembly sweeps across a lower surface of the dishwashing chamber and a vertical leg of the L-shaped spray assembly sweeps across a side wall of the dishwashing chamber, the spray assembly having channels for conveying detergent and water and further having multiple nozzles disposed along the horizontal and vertical legs of the L-shaped spray assembly for directing detergent and water on to the utensils inside the dishwashing chamber from multiple different directions as the spray assembly rotates, and a fluid inlet coupler at an end of the horizontal leg of the L-shaped spray assembly adapted for coupling to a rotatable hub of the type having duct connectors projecting downwardly parallel to an axis of rotation of the hub and fluidly coupled to respective channels of the spray assembly;

wherein the fluid inlet coupler is integrally molded with the horizontal leg of the spray assembly and comprises for each channel thereof a respective downwardly projecting inlet integrally formed with said channel, each of said inlets being adapted to couple and to seal to respective ones of the duct connectors.

6. The dishwasher according to claim 5, comprising:

a dish holder for holding dishes within the dishwashing chamber, said dish holder including a loading-unloading rotatable tray divided by a vertical water impermeable partition into two identical portions, the tray being positioned such that when one of the identical portions is within the dishwashing chamber, the other of said portions is outside the chamber and by rotation of the tray the positions of the portions are interchanged, said partition being capable of water-tight engagement with adjacent wall portions of the dishwashing chamber;

wherein the horizontal leg of the L-shaped spray assembly extends below the tray and the vertical leg of the L-shaped spray assembly extends above upper surfaces of utensils held on the tray, the nozzles on the horizontal leg being adapted for spraying liquid upwards onto lower surfaces of the utensils and the nozzles on the vertical leg being adapted for spraying liquid sideways and/or downwards with a slant, for spraying liquid on upper surfaces of the dishes.

7. The dishwasher according to claim 5, supporting toward a base thereof at least one detergent reservoir each fluidly connected via a respective filler tube to a respective trough at an upper end of the dishwasher, there being further provided in fluid communication with said trough a bottle mount dimensioned to accommodate a neck of a detergent bottle of the type having a one-way valve in a side thereof toward a base of the bottle, the one-way valve allowing for free entry of air when the bottle is emptied of detergent, the bottle mount having an upwardly projecting tube adapted to pierce a seal in said neck thereby allowing detergent to flow under gravity alone from the bottle to the reservoir.

8. The dishwasher according to claim 6, supporting toward a base thereof at least one detergent reservoir each fluidly connected via a respective filler tube to a respective trough at an upper end of the dishwasher, there being further provided in fluid communication with said trough a bottle mount dimensioned to accommodate a neck of a detergent bottle of the type having a one-way valve in a side thereof toward a base of the bottle, the one-way valve allowing for free entry of air when the bottle is emptied of detergent, the bottle mount having an upwardly projecting tube adapted to pierce a seal in said neck thereby allowing detergent to flow under gravity alone from the bottle to the reservoir.

9. The dishwasher according to claim 5, wherein the L-shaped spray assembly comprises:

a rotatable hub removably attached to the fluid inlet coupler, the rotatable hub comprising a cylindrical housing supporting the duct connectors at a lower end, each duct connector in alignment with the respective inlet of the fluid inlet coupler.

10. The dishwasher according to claim 6, wherein the L-shaped spray assembly comprises:

a rotatable hub removably attached to the fluid inlet coupler, the rotatable hub comprising a cylindrical housing supporting the duct connectors at a lower end, each duct connector in alignment with the respective inlet of the fluid inlet coupler.

11. The dishwasher according to claim 8, wherein the L-shaped spray assembly comprises:

a rotatable hub removably attached to the fluid inlet coupler, the rotatable hub comprising a cylindrical housing supporting the duct connectors at a lower end, each duct connector in alignment with the respective inlet of the fluid inlet coupler.

12. A dishwasher comprising:

a dishwashing chamber and an L-shaped spray assembly that is rotated about a vertical axis so that a horizontal leg of the L-shaped spray assembly sweeps across a lower surface of the dishwashing chamber and a vertical leg of the L-shaped spray assembly sweeps across a side wall of the dishwashing chamber, the spray assembly having channels for conveying detergent and water and further having multiple nozzles disposed along the horizontal and vertical legs of the L-shaped spray assembly for directing detergent and water on to the utensils inside the dishwashing chamber from multiple different directions as the spray assembly rotates, and a fluid inlet coupler at an end of the horizontal leg of the L-shaped spray assembly adapted for coupling to a rotatable hub of the type having duct connectors projecting downwardly parallel to an axis of rotation of the hub and fluidly coupled to respective channels of the spray assembly; and at least one detergent reservoir each fluidly connected via a respective filler tube to a respective trough at an upper end of the dishwasher, there being further provided in fluid communication with said trough a bottle mount dimensioned to accommodate a neck of a detergent bottle of the type having a one-way valve in a side thereof toward a base of the bottle, the one-way valve allowing for free entry of air when the bottle is emptied of detergent, the bottle mount having an upwardly projecting tube adapted to pierce a seal in said neck thereby allowing detergent to flow under gravity alone from the bottle to the reservoir.

13. The dishwasher according to claim 12, wherein the L-shaped spray assembly comprises:

a rotatable hub removably attached to the fluid inlet coupler, the rotatable hub comprising a cylindrical housing supporting the duct connectors at a lower end, each duct connector in alignment with the respective inlet of the fluid inlet coupler.

* * * * *